US005379704A

United States Patent [19]

Couvrette

[11] Patent Number: 5,379,704

[45] Date of Patent: Jan. 10, 1995

[54] SERVICE ACCESS SYSTEM FOR AUTOMATIC TELLER KIOSK

[76] Inventor: Edward F. Couvrette, 10821 Airport Dr., El Cajon, Calif. 92020-1202

[21] Appl. No.: 55,743

[22] Filed: May 3, 1993

[51] Int. Cl.[6] ..... G07G 5/00

[52] U.S. Cl. ..... 109/24.1; 109/2; 109/66; 109/45

[58] Field of Search ..... 109/2, 5, 8–11, 109/14, 24.1, 45–50, 53, 58, 66, 71; 49/42; 52/29, 31, 65, 67; 312/223.1, 311, 319.8, 334.27, 334.32, 334.33, 334.36, 334.39, 349, 350; 194/350; 232/43.1, 43.4

[56] References Cited

U.S. PATENT DOCUMENTS

| | | | |
|---|---|---|---|
| 3,737,191 | 6/1973 | Fackre | 52/65 X |
| 4,192,544 | 3/1980 | Patterson | 52/67 X |
| 4,399,755 | 8/1983 | Wiedmann | 109/2 |
| 4,497,261 | 2/1985 | Ferris et al. | 109/2 |
| 4,500,013 | 2/1985 | Lundblad | 109/50 X |
| 4,558,650 | 12/1985 | Berman | 109/24.1 |
| 4,577,562 | 3/1986 | Berman | 109/24.1 |
| 4,603,643 | 8/1986 | Couvrette | 109/24.1 |
| 4,649,832 | 3/1987 | Hain et al. | 109/24.1 |
| 4,856,437 | 8/1989 | Trucksess | 109/24.1 |
| 4,884,514 | 12/1989 | Shockey et al. | 109/2 X |

FOREIGN PATENT DOCUMENTS

| | | | |
|---|---|---|---|
| 50694 | 3/1991 | Japan | 194/350 |

*Primary Examiner*—Peter M. Cuomo
*Assistant Examiner*—Suzanne L. Dino
*Attorney, Agent, or Firm*—Frank D. Gilliam; John R. Duncan

[57] ABSTRACT

A system for allowing access to the automatic teller machine (ATM) in a kiosk for repair, replenishment of money, etc. The ATM is mounted on a top plate with the operating control panel extending slightly through an opening in the exterior surface of the kiosk during normal operation. The top plate is rotatably mounted on a mid-plate for rotation around a centrally located second pivot point. The mid-plate in turn is rotatably mounted on a base plate at a pivot point well separated from the second pivot point. A cam follower secured to the kiosk structure rides against a cam surface configured to cause the top plate to initially translate when rotated so that the control panel moves inwardly of the kiosk to allow the ATM to rotate 90° without interference so that the side of the ATM is exposed through the kiosk opening for replenishment of money, repair, or other servicing.

20 Claims, 3 Drawing Sheets

SERVICE ACCESS SYSTEM FOR AUTOMATIC TELLER KIOSK

BACKGROUND OF THE INVENTION

This invention relates in general to automatic teller machines (ATM) located in kiosks and, more particularly, to apparatus for permitting access to the machines for repair, replenishment or the like without requiring extensive space adjacent to the kiosk.

Self banking systems, in the form of an ATM housed in a kiosk, are coming into widespread use. While some are located outside bank branches, primarily for use when the bank is closed, others are being provided in stand-alone locations in shopping centers, parking lots, etc. for both walk-up and drive-up use. In many cases, such as when positioned on islands between drive-up lanes or in existing hallways, the kiosk must be very narrow and compact to avoid obstructing adjacent areas or driving lanes when the kiosk is positioned on an island between lanes. In addition, when the ATM requires replenishment of cash or repairs, the ATM must be accessible without obstructing adjacent areas. Also, security of the unit and resistance to break-ins must be provided due to the substantial amounts of cash often enclosed.

Typically, prior ATM kiosks have provided a swinging door arrangement which, when pivoted away from the kiosk, permits entry for repair or replenishment. These doors obstruct the adjacent area and can sometimes be easily pried open. Others use a rotating quarter-cylinder housing for the ATM, such as that described by Hain et al in U.S. Pat. No. 4,649,832. This is wasteful of space within the kiosk and obstructs the adjacent area when opened. Still other kiosks simply provide a back door through which the kiosk can be entered for access to the ATM. These, of course require a great deal of interior volume, which is not available in many locations and leaves the operating panel exposed.

Thus, there is a continuing need for improved ATM kiosks and apparatus for permitting full access to the ATM for servicing while assuring maximum security during use, occupying a minimum volume and avoiding obstructing adjacent areas during servicing.

SUMMARY OF THE INVENTION

The above noted problems, and others, are overcome in accordance with this invention by an apparatus for rotating an ATM installed in a kiosk approximately 90° from a first or operating position with the ATM control panel extending through an opening in the kiosk wall to a second or service position within the kiosk.

The ATM, including the operating controls, means for receiving deposits, cash box and means for dispensing cash, associated computer, etc. are all arranged in a generally upright rectangular box or housing. In the operating position the operating side, including keyboard, information screen and deposit receiving and cash dispensing openings, etc. are exposed and preferably extend slightly through a kiosk opening for ease of use. In the service position, the box is rotated to expose the ATM components, cash box, etc. for servicing. For optimum security the ATM is enclosed in high strength security panels or a security cylinder which covers the kiosk opening when the ATM is rotated to the servicing position.

The apparatus permitting movement of the generally rectangular ATM enclosure includes a base plate on which the ATM and the rotation mechanisms are supported. A mid-plate is rotatably mounted on the base plate for rotation about an approximately centrally located first pivot point. A top plate is in turn mounted on the mid-plate for rotation about a second pivot point, typically located adjacent to the kiosk opening, well separated from the second pivot point. A cam follower secured to the base plate (which is fastened to the kiosk structure) rides in a cam slot in a cam plate secured to the top plate. If desired, the cam follower could be mounted on other kiosk structure.

As rotation of the ATM housing and the top plate is begun (after unlocking the housing from the kiosk structure) either manually or through a conventional motor drive, the cam slot moves along the cam follower, causing the ATM to translate outwardly during initial rotation so that the back of the ATM clears the back inner wall of the kiosk. As rotation continues, the ATM is moved inwardly so that the ATM control panel clears the edge of the opening. The cam slot is configured to permit continued rotation until the service side of the ATM housing is positioned in the kiosk opening, generally about 90°, although other degrees of rotation can be provided if desired.

Upon completion of servicing, the direction of rotation of the ATM and top plate is reversed, so that the assembly rotates back toward the operating position, with the cam system causing translation as the final position is approached, with the ATM again reaching the operating position with the control panel typically slightly projecting through the opening.

The dual axis rotation system "spins" the ATM on two separate rotation pivots, under control, to allow the ATM to be moved 90° between operational and service positions. Typically this allows the placement of a 36 inches deep ATM into a 36.75 inches deep kiosk. During servicing the ATM is completely inside the kiosk, providing a safe internal environment for the service personnel and the ATM.

An object, therefore, of this invention is to provide a simple and reliable apparatus for providing movement of an ATM between operating and servicing positions which minimizes the kiosk volume required for the ATM. Another object is to provide an ATM kiosk arrangement that does not require obstruction of adjacent areas during servicing. A further object is to provide an ATM kiosk and servicing apparatus having high security and resistance to break-ins.

BRIEF DESCRIPTION OF THE DRAWING

Details of the invention, and of certain preferred embodiments thereof, will be further understood upon reference to the drawing, wherein.

DETAILED DESCRIPTION OF PREFERRED EMBODIMENTS

Figure 1A:
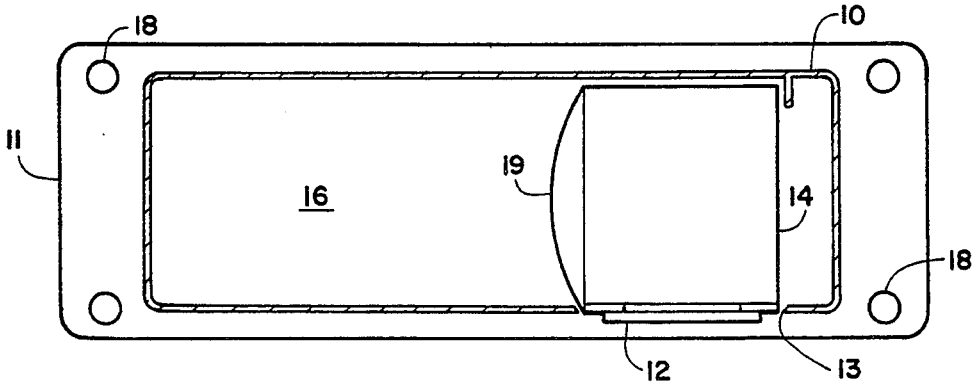
FIG. 1*a* is a schematic plan view of the interior of a stand-alone ATM kiosk incorporating the service system of this invention in the operating position.
Figure 1B:
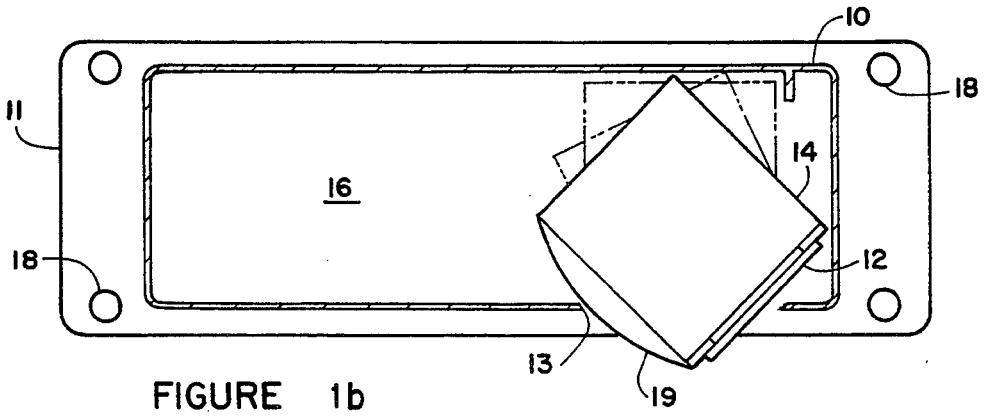
FIG. 1*b* is a schematic plan view of the interior of a stand-alone ATM kiosk incorporating the service system of this invention in the transitional position.
Figure 1C:
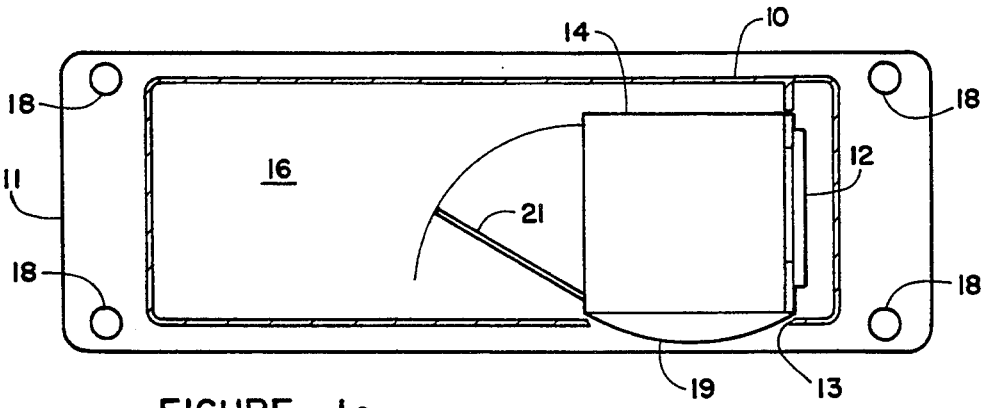
FIG. 1*c* is a schematic plan view of the interior of a stand-alone ATM kiosk incorporating the service system of this invention in the service position.

Referring now to FIGS. 1*a*, 1*b* and 1*c*, there is seen an ATM kiosk 10 of the sort in which the service access system of this invention would be used. While other external shapes may be used, in general the rectangular shape shown is preferred as best able to fit on an island 11 between drive-through lanes, at the side of a hallway, etc.

The conventional operating components of the ATM, e.g. operating panel 12, and internal components (not shown) such as a cash box, deposit receiving box, heating or cooling means and the operating computer, are located in a generally rectangular cross-section enclosure, the front of which carries operating panel 12 typically extending outwardly slightly from the body of kiosk 10 through an opening 13. The end 16 of kiosk 10 may enclose elements that rarely, if ever, require servicing, such as heating or cooling ducts and provides an enclosure for workers servicing ATM 14. Security posts 18 may be provided to physically protect kiosk 10. A security cylinder 19 is provided to cover the side of ATM 14 that is exposed during servicing.

In the sequence of operation, as seen in FIG. 1*a*, originally ATM 14 is positioned with operating panel 12 exposed for use by customers. In order to service the ATM, the ATM is rotated and translated through the sequence illustrated in FIG. 1*b* by a service person in kiosk area 16 so that the side opposite operating panel 12 is exposed to space 16 within kiosk 10. Initially, ATM 14 is rotated and moved toward opening 13 so that the back corner of the ATM can clear the inside back wall of kiosk 10. As rotation continues, ATM 14 translates slightly inwardly of kiosk 10 so that the edge of control panel 12 clears the edge of opening 13. Finally, as illustrated in FIG. 1*c*, the service position is reached. Security cylinder surface 19 closes opening 13. The service worker opens a high security safe door 21 at the back of ATM 14 and proceeds with servicing, e.g. replenishment of cash, repairs, etc. With the exterior kiosk door closed, the worker is in a secure environment.

Figure 2:
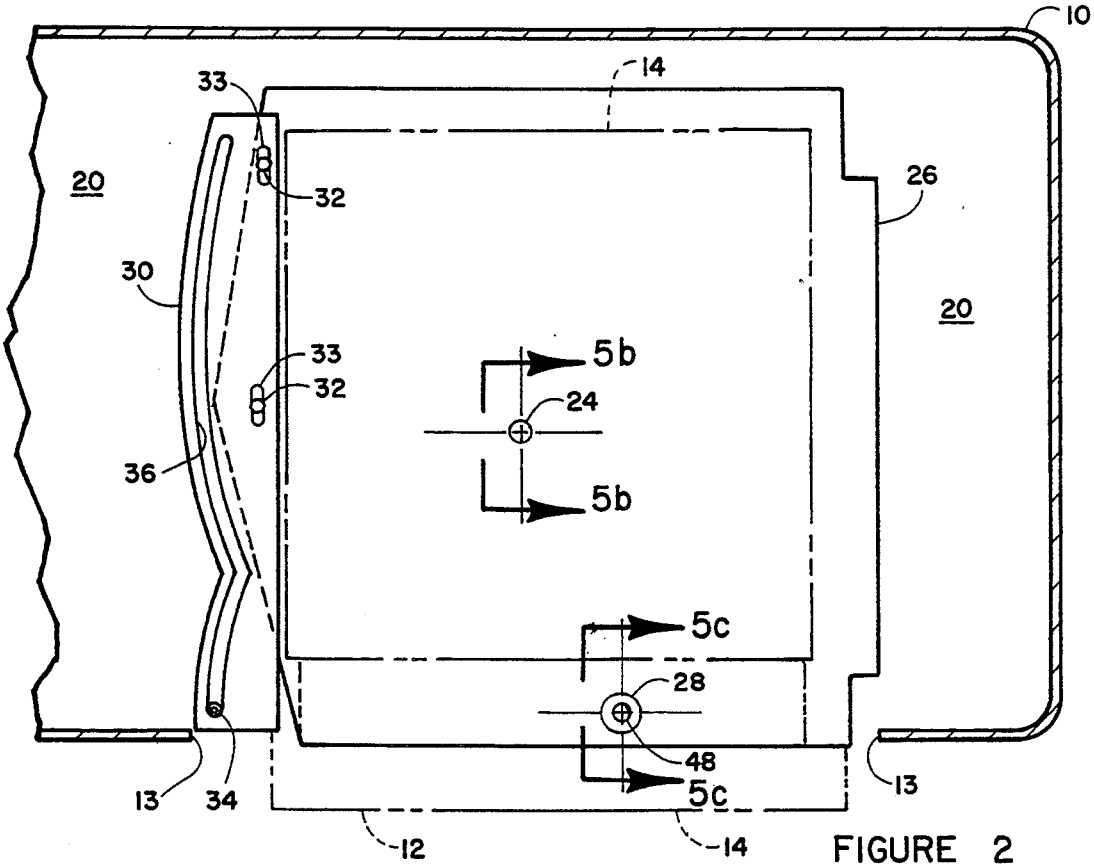
FIG. 2 is a schematic plan view of the ATM support and rotation system in the ATE operating position.

FIG. 2 shows a schematic plan view of the support system upon which ATM 14 rests and to which the ATM is secured. FIG. 2 shows the system in the ATM operating position. A base plate 20 fills the bottom of kiosk 10, supporting all internal components and preventing entry through the kiosk bottom should the kiosk be tipped over. Of course, base plate 20 could be a smaller support plate fastened to a kiosk base if desired. A mid-plate 22 (hidden in FIG. 1 but shown in FIG. 6) is rotatably supported on base plate 20 for rotation about an approximately central bearing (not seen in FIG. 1 but located at schematically indicated point 24).

Figure 5A:
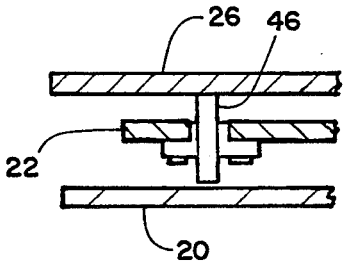
FIG. 5*a* is a schematic detail section view of the upper plate roller support system, taken on line 5*a*—5*a* in FIG. 6.
Figure 5B:
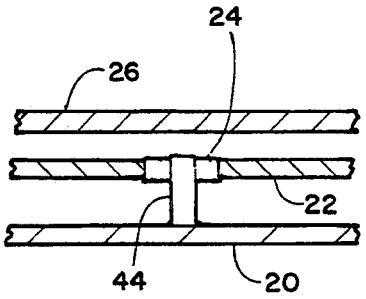
FIG. 5*b* is a schematic detail section view of the mid-plate pivot system, taken on line 5*b*—5*b* in FIG. 2.
Figure 5C:
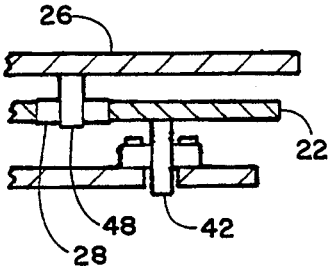
FIG. 5*c* is a schematic detail section view of the top plate roller support and the top plate pivot system.

Details of the bearing and roller rotation supports are shown in FIGS. 5*a*–5*c*. A top plate 26 is rotatably mounted on mid-plate 22 for rotation about a bearing 28. Details of the roller supports 46 (typically rollers or wheels rotatable about a horizontal axis) for top plate 26 are seen in FIG. 5*a*.

A cam plate 30 is fastened to the edge of top plate 26, such as by bolts 32. Provision is preferably made, such as by slots 33 in cam plate through which bolts 32 pass, to permit the position of cam plate 30 relative to top plate 26 to be adjusted, if desired. Other fastening means, such as welding, may be used, if desired. A cam follower 34 is rigidly fastened to base plate 20 and extends into cam slot 36 in cam plate 30.

As the assembly is rotated, cam slot moves along cam follower 34, constraining the rotation rates of top plate 26 and mid-plate 22 relative to base plate 20, so that during initial rotation ATM 14 translates inwardly to clear the edges 13 of the opening through which the control panel of ATM 14 projects.

Figure 3:
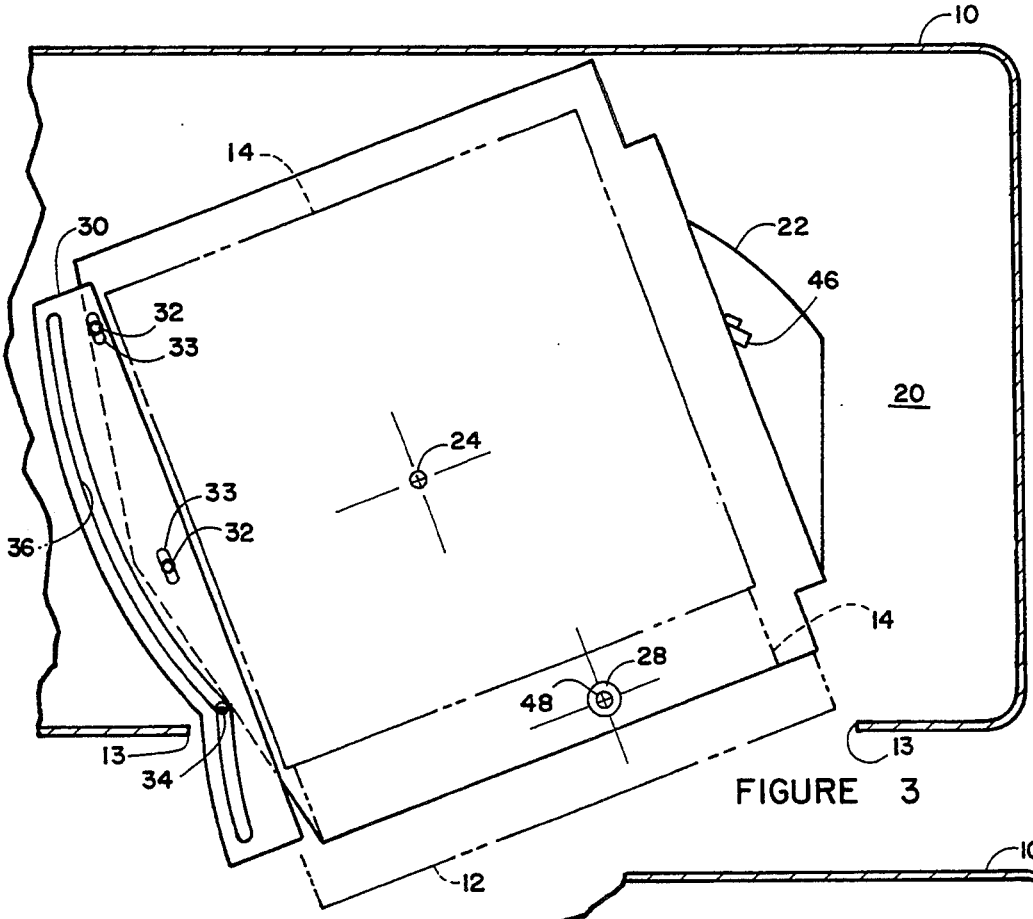
FIG. 3 is a schematic plan view of the system of FIG. 2 after about 20° rotation toward the service position.

FIG. 3 is a schematic plan view corresponding to FIG. 2, but showing the system after about 20° rotation. In order to begin rotation, a suitable conventional lock (not shown) holding the ATM 14 in the operating position is first released. Then rotation in a counterclockwise direction is initiated, manually by simply grasping the ATM 14 from within kiosk 10 or the extended front panel 12 from outside kiosk 10 and pushing panel toward the right or by activating a conventional electric motor drive. Top plate 26 begins to rotate about bearing 28 and mid-plate 22 begins to rotate about point 24, with the relative degree of each rotation constrained by cam slot 36 riding along cam follower 34. Initial rotation primarily moves the left front corner of operating panel 12 forwardly and the right front corner rearwardly so that the right corner clears the right edge 13. Once the corners are clear, at the point in rotation shown in FIG. 3, cam slot 36 becomes a generally circular slot about point 24 so that the plates and ATM simply rotate together to the desired final position. Just sufficient space is provided within the kiosk to permit the back of ATM 14 to just clear the back inside wall.

Figure 4:
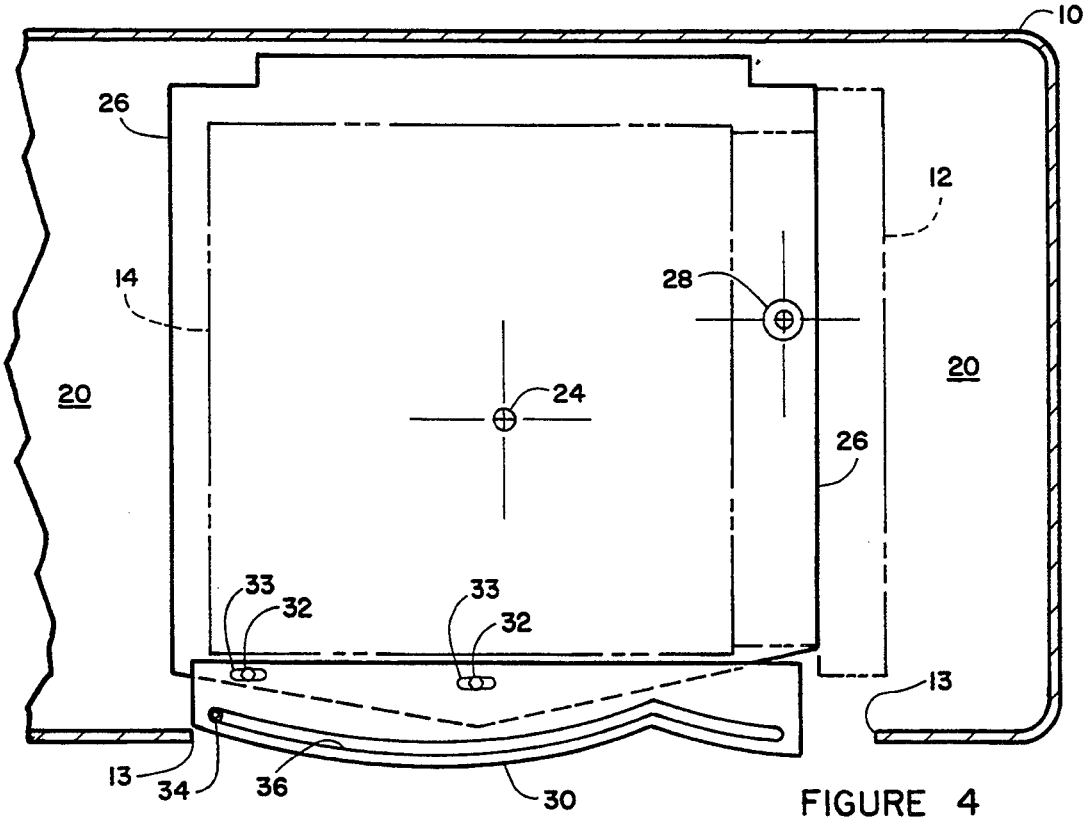
FIG. 4 is a schematic plan view of the system of FIG. 2 after full rotation to the service position.

Rotation is preferably continued until ATM 14 lies at about 90° to the original position, as seen in FIG. 4. The entire back of ATM 14 is then accessible for service. The surface of security cylinder 19 (not seen in FIG. 4 but seen in FIG. 1) closes opening 13. Preferably a conventional lock, stop or detent (not shown) is provided to releasably hold the ATM in the service position during servicing. Upon completion of servicing, ATM 14 is rotated back to the operating position and is again ready for use.

Figure 6:
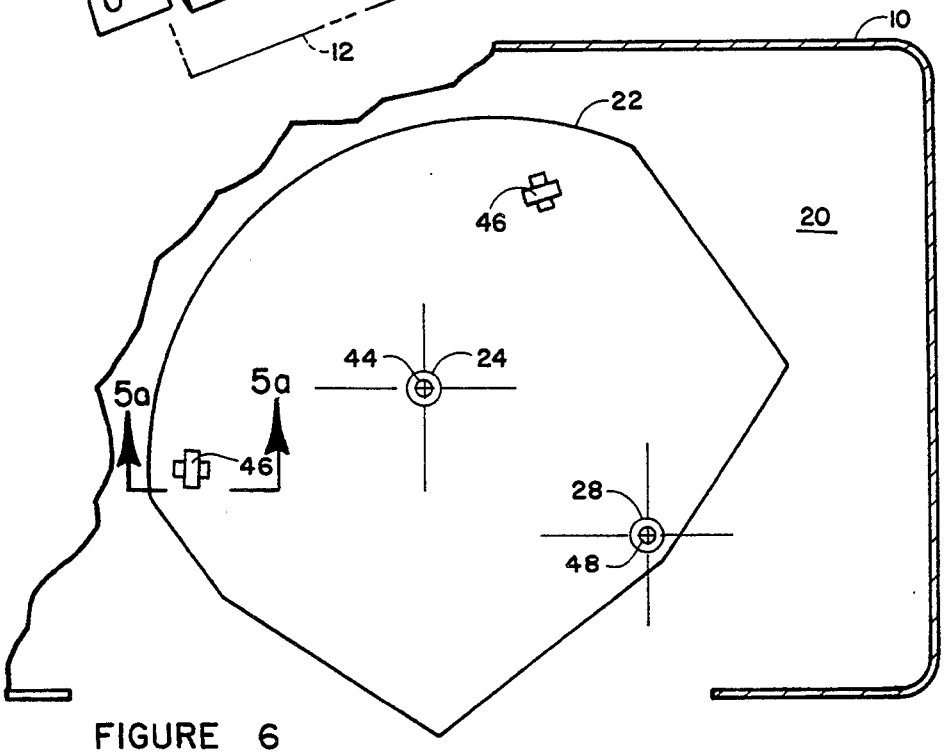
FIG. 6 is a schematic plan view of the mid-plate in the support system, taken on line 6—6 in FIG. 5.

FIGS. 5*a*, 5*b* and 5*c* are schematic partial section views, illustrating the relationship of the three plates and their several pivot bearings and support rollers. Base plate 20 may form the bottom of kiosk 10, or could be a separate removable plate secured to a bottom closure of the kiosk, as desired. FIG. 5*a*, taken on line 5*a*—5*a* in FIG. 6 illustrates the manner in which roller 46, rotatable about a horizontal axle secured to mid-plate 22, supports top plate 26. FIG. 5*b*, taken on line 5*b*—5*b* in FIG. 2, illustrates the rotation of mid-plate 22 about bearing 24 and shaft 44 which is secured, such as by welding, to base plate 20. FIG. 5*c*, taken on line 5*c*—5*c* in FIG. 2, illustrates the support rollers 42, mounted for rotate on about a horizontal axle secured to base plate 20, that support mid-plate 22 for movement thereacross and bearing 48 and shaft 48 secured to top plate 26 and about which top plate 26 rotates.

The plurality of conventional roller bearings 42 and 46 are preferably curved surface self-aligning pillow block bearings. Any suitable number of plate supporting roller bearings 42 and 46 may be used. Bearings 24 and 28 are typically conventional thrust bearings.

ATM 14 is mounted on top plate 26 by any suitable method, such as welding or bolts. Operating panel 12 extends through the opening in the kiosk 10, as described above.

FIG. 6 shows a detail plan view of mid-plate 22. Mid-plate 22 has a suitable outline for clearing all adjacent structures as the plate assembly rotates and translates. Mid-plate 22 pivots about bearing 24 and shaft 44 extending down to (and secured to) the base plate. Rollers 46 and bearing 28 support top plate 26 and the ATM 14 carried thereby with bearing shaft 48 extending upwardly into engagement with the top plate. Additional support rollers 46 may be provided, if desired, depending upon the weight of the ATM and top plate to be supported.

Other applications, variations and ramifications of this invention will occur to those skilled in the art upon reading this disclosure. Those are intended to be included within the scope of this invention, as defined in the appended claims.

I claim:

1. A service access system for an automatic teller machine (ATM) kiosk permitting movement of the ATM between operating and service positions which comprises:

a kiosk adapted to contain an ATM with only one side of the ATM exposed at the kiosk exterior through an opening in the kiosk;

a fixed base plate in said kiosk;

a mid-plate mounted on said base plate for rotation relative thereto about a first pivot point;

a top plate mounted on said mid-plate for rotation relative thereto about a second pivot point spaced from said first pivot point;

cam means attached to one of said plates;

cam follower means mounted on said base plate in contact with said cam means to follow said cam means during relative movement of said plates;

security cylinder means covering at least one side of said ATM;

whereby rotation of said ATM will cause said mid-plate and top plate to rotate about their respective pivot points while said cam means causes said nod plate to translate to the extent necessary to permit said ATM to clear the sides of said opening and said security cylinder means to cover said opening.

2. The system according to claim 1 wherein said one side of the ATM which is exposed through said opening is selectively a control panel for operating the ATM in normal use and a high strength security surface during servicing.

3. The system according to claim 1 wherein said cam means is a cam slot in a cam plate secured to one of said plates and adapted to receive said cam follower in said slot.

4. The service access system according to claim 3 wherein said cam plate is secured to said one of said plates in a manner permitting adjustment of the relative positions of said cam plate and top plate.

5. The system according to claim 3 wherein said cam slot is configured to, during rotation of said ATM, initially move said ATM toward said opening to permit the back of said ATM to clear the interior wall of said kiosk, then move said ATM away from said opening to permit the side of the ATM originally exposed through said opening to clear the sides of said opening.

6. The system according to claim 1 wherein the kiosk is generally rectangular, with the ATM adjacent to and across one narrow end of said rectangle and said ATM is rotatable approximately 90° so that the side of said ATM which was exposed through said opening faces adjacent to a kiosk end and the opposite side is exposed to the kiosk interior for servicing.

7. The system according to claim 6 wherein said opposite side includes a high security door covering a large portion of said opposite side which is openable within said kiosk for servicing of the ATM.

8. The service access system according to claim 1 wherein a second pivot means comprises a second vertical ball or roller bearing between said top plate and said mid-plate at the pivot point of said top plate and a plurality of support rollers arranged around said pivot point between said top plate and said mid-plate.

9. The service access system according to claim 8 wherein said second vertical bearing is secured in an opening in said midplate and has a vertical shaft secured to said top plate.

10. The service access system according to claim 1 wherein said cam means is secured to said top plate.

11. The system according to claim 3 wherein said cam plate is secured to said top plate.

12. A service access system for an automatic teller machine (ATM) kiosk permitting movement of the ATM between operating and service positions which comprises:

a kiosk adapted to contain an ATM with only one side of the ATM exposed at the kiosk exterior through an opening in the kiosk;

a fixed base plate in said kiosk;

a mid-plate mounted on said base plate for rotation relative thereto about a first pivot point;

a top plate mounted on said mid-plate for rotation relative thereto about a second pivot point spaced from said first pivot point;

a first pivot means comprising a first vertical ball or roller bearing between said mid-plate and said base plate at said first pivot point of said mid-plate and a plurality of support rollers arranged around said first pivot point between said base plate and said mid-plate;

cam means attached to one of said plates;

cam follower means secured to said kiosk in contact with said cam means to follow said cam means during relative movement of said plates;

security cylinder means covering at least one side of said ATM;

whereby rotation of said ATM will cause said mid-plate and top plate to rotate about their respective pivot points while said cam means causes said top plate to translate to the extent necessary to permit said ATM to clear the sides of said opening and said security cylinder means to cover said opening.

13. The service access system according to claim 12 wherein said first vertical bearing is secured in an opening in said mid-plate and has a vertical shaft secured to said base plate.

14. The system according to claim 12 wherein said one side of the ATM which is exposed through said opening is selectively a control panel for operating the ATM in normal use and a high strength security surface during servicing.

15. The system according to claim 12 wherein said cam means is a cam slot in a camplate secured to one of said plates and adapted to receive said cam follower in said slot.

16. The service access system according to claim 15 wherein said cam plate is secured to said one of said plates in a manner permitting adjustment of the relative positions of said cam plate and top plate.

17. The system according to claim 12 wherein the kiosk is generally rectangular, with the ATM adjacent to and across one narrow end of said rectangle and said ATM is rotatable approximately 90° so that the side of said ATM which was exposed through said opening faces adjacent to a kiosk end and the opposite side is exposed to the kiosk interior for servicing.

18. The system according to claim 17 wherein said opposite side includes a high security door covering a large portion of said opposite side which is openable within said kiosk for servicing of the ATM.

19. The service access system according to claim 12 wherein said second pivot means comprises a second vertical ball or roller bearing between said top plate and said mid-plate at the pivot point of said top plate and a plurality of support rollers arranged around said pivot point between said top plate and said mid-plate.

20. The service access system according to claim 19 wherein said second vertical bearing is secured in an opening in said mid-plate and has a vertical shaft secured to said top plate.

* * * * *